US006106177A

United States Patent [19]

Siegl et al.

[11] Patent Number: 6,106,177

[45] Date of Patent: Aug. 22, 2000

[54] WEB TENSION CONTROL DEVICE

[75] Inventors: Walter Siegl, Bern; Olivier Stehlin, Zollikofen, both of Switzerland

[73] Assignee: Maschinenfabrik Wifag, Bern, Switzerland

[21] Appl. No.: 09/364,952

[22] Filed: Jul. 30, 1999

[30] Foreign Application Priority Data

Jul. 31, 1998 [DE] Germany ..... 198 34 725

[51] Int. Cl.[7] ..... B41J 11/26

[52] U.S. Cl. ..... 400/618; 101/228

[58] Field of Search ..... 101/DIG. 42, 228; 400/618; 226/27, 29, 2, 30

[56] References Cited

U.S. PATENT DOCUMENTS

| | | | |
|---|---|---|---|
| 5,269,222 | 12/1993 | Johnson et al. | 101/228 |
| 5,365,844 | 11/1994 | Miyashige | 101/228 |
| 5,791,541 | 8/1998 | Jitsuishi et al. | 226/40 |
| 5,937,756 | 8/1999 | Kishine et al. | 101/228 |
| 5,947,023 | 9/1999 | Bohrer et al. | 101/181 |

*Primary Examiner*—John S. Hilten
*Assistant Examiner*—Charles H. Nolan, Jr.
*Attorney, Agent, or Firm*—McGlew and Tuttle, P.C.

[57] ABSTRACT

A control device for controlling the tension of a paper web of a printing press is provided with a setting device for a speed master set point, with a speed controller for a drive motor, which is coupled with the setting device, with a setting device for a web tension set point, with a sensor for measuring the web tension, with a web tension controller, which is coupled with the sensor for measuring the web tension and with the setting device for the web tension set point. The speed controller is coupled with an output of the web tension controller. A process is also provided for controlling the tension of a paper web of a printing press, wherein a speed master set point is preset, a web tension set point is preset, a first web tension actual value is measured, the difference between the web tension set point and the measured web tension actual value is formed; the difference formed is converted into a lag set point, and a variable, which is used to control the speed of rotation of the drive motor, is formed from the preset speed master set point and the lag set point.

19 Claims, 6 Drawing Sheets

WEB TENSION CONTROL DEVICE

FIELD OF THE INVENTION

The present invention pertains to a web tension control device and is suitable especially for rotary offset presses of the tower design driven in a shaftless manner, preferably for newspaper offset printing.

BACKGROUND OF THE INVENTION

The accurate setting and control of the paper web tension in rotary offset presses during the printing process is of great significance. The accurately set web tension is necessary not only for achieving a good print quality, because not only are, e.g., color and crop marks better maintained, but it also leads to an increase in printing productivity, because fewer or no paper tears are caused. Defined web tension profiles are therefore usually preset along the individual paper paths, i.e., predetermined upper and lower limit values of the web tension shall not be overshot and undershot.

However, the modulus of elasticity of the paper may change greatly from one paper roll to the next, which may lead to an abrupt change in the web tension. This happens, e.g., at the time of the change of the rolls and has a highly adverse effect on the quality of the printed product. Furthermore, the modulus of elasticity of the paper may also change within the same paper roll, because the inner and outer layers of the paper roll have different moisture contents due to, e.g., storage. These changes in the modulus of elasticity of the paper lead to changes in the color and crop mark during the unrolling of the paper and consequently to an impairment in quality because of the resulting changes in the web tension and the stretching of the paper. Varying ink and moisture densities also cause changes in the modulus of elasticity.

Another influencing variable affecting the tension of the paper web are transient processes, e.g., ramp-like changes in the velocity of the paper web, or even the movement of a blanket cylinder between a print-on position and a print-off position. These transient processes frequently occur, e.g., in rotary offset presses driven in a shaftless manner with a so-called "flying" plate change functionality, where different production runs take place consecutively without stopping the printing presses. The web tension is strongly affected and changed each time here.

Since these changes in the web tension lead to an impairment in the print quality, increasingly better controls, which will be described below, were developed for maintaining the preset web tension profile.

1. Simple Web Tension Control

FIG. 4*a* shows a prior-art web tension control device. A web tension set point $F_{SOLL}$ is preset by a press control and a web tension controller determines a lag set point $\Delta N_{SOLL}$ from a difference between the web tension set point $F_{SOLL}$ and a web tension actual value $F_{IST}$ measured by a web tension measuring sensor.

A speed master set point $N_{SOLL}$ is picked off a folder arranged at the end of the printing process. However, since the folder already has a noncontinuous mode of operation due to its function, the speed master set point $N_{SOLL}$ determined from this cannot be used directly for the web tension control, but it must first be subjected to a low-pass filtration in order to suppress higher-frequency interfering components of the speed master set point signal $N_{SOLL}$. The speed master set point $N_{SOLL}$ subjected to low-pass filtration is combined with the lag value $\Delta N_{SOLL}$ from the web tension controller and the speed actual value $N_{IST}$ of the roller driven by the drive motor, and the signal obtained is sent to the speed controller, which drives the drive motor.

However, the compulsory low-pass filtration of the speed master set point $N_{SOLL}$ from the folder is disadvantageous, because this low-pass filtration leads to an inertia of the entire control and the speed master set point intensely damped by the low-pass filtration influences the entire control dynamics of the web tension control, because the control parameters of the web tension controller must be coordinated with the control parameters of the downstream speed controller.

2. Lag Control

The lag control is a simple and rapid speed control.

As is shown in FIG. 4*b*, a value $\Delta N$, which is determined from a difference of a speed master set point $N_{SOLL}$ from, e.g., a bus system and a measured set point $N_{IST}$ of the speed, as well as a lag set point $\Delta N_{SOLL}$, is sent to the speed controller. This speed controller drives the drive motor in the known manner.

However, it is necessary to set the lag set points $\Delta N_{SOLL}$ before start-up such that a desired web tension is reached, and $\Delta N_{SOLL}=n \cdot N_{SOLL}$ applies. Here, n denotes the lag.

Even though the lag control can be embodied in a very simple manner and it avoids the drawbacks of the web tension control that are due to the low-pass filtration, the lag control still has drawbacks. For example, the resulting web tension depends on the velocity of the paper web. This means that the web tension cannot be maintained at a constant value. e.g., during a velocity ramp, without secondary corrections of the speed master set points $N_{SOLL}$. As was mentioned above, this leads to an impairment in the quality of the printed products. Furthermore, a great variation of the paper web tension has an extremely adverse effect, e.g., in the case of an normal stop or an emergency stop of the printing press, because the web tension may increase extremely greatly in the case of the pure speed control, which may easily lead to the paper web being torn off. Furthermore, the web tension is also subject to great variations during the print-on or print-off operation of all print positions of, e.g., an eight-up tower, which is likewise undesirable.

3. Lag Control with Droop Functionality

To overcome the drawbacks of the above-mentioned two control devices, a lag control with a so-called droop functionality was proposed. The speed master set point $N_{SOLL}$ for the speed controller of the drive of the draw-in mechanism is corrected as a function of the load moment of this drive here, the load moment being proportional under steady-state conditions to the web tension.

FIG. 4*c* shows such a lag control with droop functionality. A difference $\Delta N$, which is formed from a speed master set point $N_{SOLL}$, a speed actual value $N_{IST}$, and another correcting variable $N_M$, which is determined from a measured motor load moment, as well as from a lag set point $\Delta N_{SOLL}$, is again sent to a speed controller.

Contrary to a pure speed control, the control with droop functionality offers the advantage that interferences resulting from changes in the modulus of elasticity of the paper and print-on or print-off operations cause only minor deviations of the web tension. However, interferences resulting from a change in the modulus of elasticity of the paper cause a permanent deviation of the web tension unless the value of $\Delta N_{SOLL}$ is corrected secondarily. This causes a desired web tension value not being able to be maintained after an interference without a corresponding adjustment of the value of $\Delta N_{SOLL}$, because the instantaneous modulus of elasticity of the paper web is usually unknown.

FIG. 5 shows a linearized diagram, in which the speed N of the draw-in mechanism at a certain press speed is plotted on the abscissa, and the velocity F of the paper web is plotted on the ordinate. The straight lines $E_1$ and $E_2$ are shown for two different moduli of elasticity of a paper web, and the modulus of elasticity of a paper web may vary between these two straight lines shown as examples. The qualitative characteristic of the simple web tension control device is designated by 1, the characteristic of the lag control is designated by 2, and the characteristic of the lag control with droop functionality by 3.

If, e.g., the modulus of elasticity of the paper web changes from $E_1$ to $E_2$, a difference $\Delta F_2$ of the web tension is obtained in the case of a lag control (characteristic 2), and this difference is substantially greater than the difference in web tension that occurs in the case of a lag control with droop functionality, as is indicated by $\Delta F_3$ in FIG. 5. This illustrates the advantage of this control.

However, even such a smaller variation in the web tension is still disadvantageous, e.g., in respect to the quality of the printed products obtained, due to the deviation of the color and crop marks.

SUMMARY AND OBJECTS OF THE INVENTION

The primary object of the present invention is to propose a control device for controlling the tension of a paper web of a printing press that avoids the drawbacks of the prior-art controls. In particular, a control device and a control process is provided, with which the web tension can be controlled rapidly and accurately.

According to the invention, a control device is provided for controlling the tension of a paper web of a printing press with a setting device for a speed master set point ($N_{SOLL}$); and a speed controller for a drive motor, which is coupled with the setting device for the speed master set point ($N_{SOLL}$). A setting device for a web tension set point ($F_{SOLL}$) is provided as well as a sensor for measuring the web tension ($F_{IST}$). A web tension controller is coupled with the sensor for measuring the web tension ($F_{IST}$) and with the setting device for the web tension set point ($F_{SOLL}$). The speed controller is coupled with an input ($\Delta N_{SOLL}$) of the web tension controller.

A process is also provided for controlling the tension of a paper web of a printing press, in which a speed master set point ($N_{SOLL}$) is preset, a web tension set point ($F_{SOLL}$) is preset, a first web tension actual value ($F_{IST}$) is measured. The difference ($\Delta F$) between the web tension set point ($F_{SOLL}$) and the measured web tension actual value ($F_{IST}$) is formed, the difference ($\Delta F$) formed is converted into a lag or lead set point ($\Delta N_{SOLL}$) and a variable ($\Delta N$), which is used to control the speed of rotation of the drive motor, is formed from the preset speed master set point ($N_{SOLL}$) and the lag or lead set point ($\Delta N_{SOLL}$).

The advantages associated with the present invention are achieved by the fact that both the speed master set point $N_{SOLL}$ and the web tension set point $F_{SOLL}$ can be preset in a freely selectable manner, e.g., by a press control. As a result, a speed master set point $N_{SOLL}$, which does not need to be filtered and is available as a control variable without distortion, can be preset in real time. The control device can thus adjust the paper web tension directly and without inertia after an interference variable has occurred. The web tension set point $F_{SOLL}$ can likewise be preset in a freely selectable manner and consequently such as to optimize the print quality, so that the two set point variables $F_{SOLL}$ and $N_{SOLL}$, which are important for the control process, can be freely preset for the control. A control circuit for the web tension makes it possible to rapidly take into account changes in the printing conditions, which are caused, e.g., by a change in the modulus of elasticity of the paper or by a print-on or print-off operation of blanket cylinders on the paper web during the control process in order to guarantee a constant paper web tension during the operation, and the speed of rotation can be adjusted rapidly at the same time.

The simultaneous presetting of the web tension set point $F_{SOLL}$ generated and of the speed master set point $N_{SOLL}$ generated also make possible a better driving of the control device, because two set points can be preset for the control in a freely selectable manner and they can also be changed rapidly, e.g., by the machine control, without operations of the normal printing process having to be taken into account, which always leads to an inertia of the entire control due to run times.

The difference between the speed master set point $N_{SOLL}$ and the lag set point $\Delta N_{SOLL}$, which was determined by the web tension controller from the web tension set point $F_{SOLL}$ and the web tension actual value $F_{IST}$, is sent to the speed controller of the control device according to the present invention in order to drive the motor such that a desired, preferably constant web tension can be obtained at a preset speed of rotation.

Due to the use of an undisturbed speed master set point signal for the subordinate speed control circuit, the web tension control device according to the present invention thus makes possible a better coordination between the web tension control circuit and the speed control circuit. As a result, interferences in the web tension can be controlled, e.g., before the draw-in mechanism in a time-optimized manner. This leads to very good dynamic properties of the control according to the present invention, which are necessary for maintaining a constant web tension during the above-mentioned changes in the operating states. Changes in the web tension in the printing tower proper can also be limited with the control according to the present invention, because these changes can be estimated as to their orders of magnitude, and these changes remain more or less the same regardless of the type of the paper, the moisture content and other interference variables. Thus, the color marks and the crop marks can be better maintained with the control according to the present invention, because stretching of the web can be limited to a certain narrow range. The web tension control according to the present invention also has the advantage that the web tension can always be maintained in a range suitable for the paper being used, so that paper tear can be avoided.

It is possible to provide the control device according to the present invention either alone, e.g., at the draw-in mechanism or at the draw-out mechanism. Furthermore, it is also possible for the control according to the present invention to be used both to control the web tension at the draw-in mechanism and for control at the draw-out mechanism. Such a control of the draw-in and draw-out mechanisms of the printing tower offers the advantage that the web tension can be controlled over the entire web length through the printing tower, so that a particularly favorable web tension curve, preferably a constant web tension curve, is obtained from the draw-in mechanism over the printing tower to the draw-out mechanism. In the case of such an embodiment of the present invention, the web tension controllers are arranged at the draw-in mechanism or at the draw-out mechanism or both, which are to be controlled. The control according to the present invention may also be arranged individually or together with other control devices at other points of the paper web, e.g., in the printing tower itself or the funnel draw-in roller.

It is advantageous to send the web tension set point $F_{SOLL}$ to the control device via a bus system. It is especially preferable to transmit the speed master set point $N_{SOLL}$ via a high-speed bus. A real-time bus system, e.g., a SERCOS BUS, is especially suitable for this. This driving of the control device or control devices by such a bus system considerably simplifies the driving of the control at a printing tower, because all set points can thus be preset for the control by a remote machine control. The local input of set points can thus be abandoned. Furthermore, such a bus system makes it possible to drive different printing towers via a single bus, which can in turn preset different, but coordinated set points for the particular printing towers. The individual printing towers can thus be operated individually with different web tensions or with different web paths.

To achieve a desired, preferably constant, web tension over the entire course of the paper web, it is advantageous to provide more than one web tension sensor for determining different actual values as input variables of a single control device. For example, in the case of a web tension control at the draw-in mechanism, the web tension at the draw-out mechanism and/or the web tension at the funnel draw-in roller or at any other suitable measuring point may also be used as an input variable for the control device, besides the web tension at, e.g., the draw-in mechanism itself. It is, of course, also conceivable to use only the web tension at, e.g., the draw-out mechanism or at the funnel draw-in roller for controlling the web tension of the draw-in mechanism and it is, of course, also possible to use one or more additional web tension sensor signals here. For example, the web tension control of the draw-in mechanism may use the web tensions at the draw-out mechanism and at the funnel draw-in roller as the only actual values of the control to control the paper web tension.

Corresponding embodiments apply analogously to the control of the web tension at the draw-out mechanism, which is likewise able to control the paper web tension as a function of the web tension actual value of a single web tension sensor, which does not necessarily have to the arranged at the draw-out mechanism itself. Any desired combination of two or more web tension actual value signals of individual web tension sensors may also be used for the control of the web tension at the draw-out mechanism to control the paper web tension.

It is advantageous for the web tension actual values picked up by the web tension sensor or by the individual web tension sensors to be first sent to a transfer element or to different transfer elements with a suitable transfer function before they are used as input variables of the web tension control. The individual transfer elements may be used, e.g., to weight the percentages of every actual value signal for an overall web tension actual value. It is, of course, also possible to first send every individual actual value measured by a web tension sensor to a transfer element with a suitable dynamic transfer function, e.g., a $PT_1$ or $PT_2$ element, before it is sent to the web tension control or is linked with other, optionally also weighted or dynamically changing web tension actual values. By taking a plurality of weighted and dynamically evaluated web tension actual values into account in this manner, it is possible to take into account changes within the printing tower, which are due, e.g., to the moisture content in the paper and to changes occurring along the usually long paper paths between, e.g., the draw-out mechanism and the funnel draw-in roller, for the control of the entire paper web tension. Preset web tension values can be maintained within certain limits along the entire path of the paper web by the suitable parametrization and setting of the individual weighting and transfer function elements of the respective individual web tension actual value signals picked up, and preset limit values will not be overshot and undershot. The above explanations apply to both an individual web tension control at the draw-in mechanism and an individual web tension control at the draw-out mechanism, and the two web tension controls may also be used combined. Every individual of these web tension controls may use as the input variable, e.g., an actual value $F_{IST}$ which may have been determined by any desired web tension measuring sensor after passage through a corresponding transfer function block, and a weighted sum of a plurality of signals may, of course, also be used for an individual web tension control.

Cross-coupled web tension actual values of, e.g., the draw-in mechanism, the draw-out mechanism and the funnel draw-in roller, but also of other measuring points of the paper web may advantageously also be used for controlling a web tension. A value $F_{EW}$, which is preferably determined from a cross coupling of the measured web tension values $F_{IST}$ at the draw-in mechanism, at the draw-out mechanism and at the funnel draw-in roller, is sent, in particular, to the web tension control at the draw-in mechanism. Corresponding statements may also be made concerning the web tension control at the draw-out mechanism. Thus, in the case in which, e.g., three web tension actual values are to be considered, the following matrix notation is obtained for the embodiment with two control devices for the values $F_{EW}$ and $F_{AW}$ sent to the web tension controls:

$$\begin{pmatrix} F_{EW} \\ F_{AW} \end{pmatrix} = \begin{pmatrix} \alpha_1 \alpha_2 \alpha_3 \\ \alpha_4 \alpha_5 \alpha_6 \end{pmatrix} \begin{pmatrix} F_{1ST\cdot EW} \\ F_{1ST\cdot AW} \\ F_{1ST\cdot TW} \end{pmatrix}$$

The coupling matrix for, e.g., two web tension controls, which take into account three web tension actual values each, consists of 2×3=6 elements, which are designated by $\alpha_1$ through $\alpha_6$. A matrix element $\alpha_i$ does not necessarily have to be a constant, but it may also represent a dynamic transfer function. Advantages can be achieved under certain operating conditions by means of such a web tension control device, comprising, e.g., two local web tension control devices for the draw-in mechanism and the draw-out mechanism with a coupling member, which is composed of a plurality of transfer functions. For example, it is possible to locally control the web tension at the inlet and the outlet of the printing tower while the corresponding web tension actual values at the inlet and the outlet of the printing tower are mutually taken into account at the same time. The goal of such a cross-coupled web tension control is to guarantee the optimal web tension during the entire printing process over the entire paper web and to minimize crop mark deviations in between, so that the individual elements $\alpha_i$ of the coupling matrix must be set in a suitable manner. Such a cross coupling of at least two input signals of two different web tension sensors may, of course, also be used not only for a single web tension control, but also for three or more web tension controls, and optionally also of the cylinders within the printing tower. The number of measured input variables of the cross coupling, i.e., of the web tension actual values measured, is not limited to three. It is also possible to use two or more than three input signal actual values, in which case the measuring sensors are arranged in suitable locations.

A speed master set point $N_{SOLL}$ and a web tension set point $F_{SOLL}$ are preset in the process according to the present invention for controlling the tension of the paper web of a printing press. A first web tension actual value $F_{IST}$ is measured. Depending on whether a draw-out mechanism or a draw-in mechanism is involved, a lead or lag set point $\Delta N_{SOLL}$ is determined from the difference $\Delta F$ between the web tension set point $F_{SOLL}$ and the measured web tension actual value $F_{IST}$ by a web tension controller. The difference $\Delta F$ formed may be used, e.g., for a PI control algorithm to obtain a lag or lead value. The lead or lag set point $\Delta N_{SOLL}$ is added to the speed master set point $N_{SOLL}$ or subtracted from same, and the result obtained is used as the input variable of a control that controls the speed of a drive motor, which can also take into account a measured speed actual value $N_{IST}$ as an additional input variable. The same advantages as those described above in connection with the control device according to the present invention can be achieved by this embodiment of the paper web tension control according to the present invention.

At least one measured web tension actual value $F_{IST}$ is preferably used, e.g., at the draw-in mechanism, the draw-out mechanism or the funnel draw-in roller for the control according to the present invention, and it is, of course, also possible to use any combination of these web tension actual values, optionally being combined with a suitable transfer function, as was described above, for controlling the web tension. As was described above, the individual web tension actual value may also be cross-coupled before it is used as an input variable for the control process.

As was mentioned above, it is, of course, also possible to control the web tension either locally at the draw-in mechanism or at the draw-out mechanism, or at both, and the above-mentioned different input variables may be used for the individual control processes.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 4*a* through

DESCRIPTION OF THE PREFERRED EMBODIMENT

Figure 1:
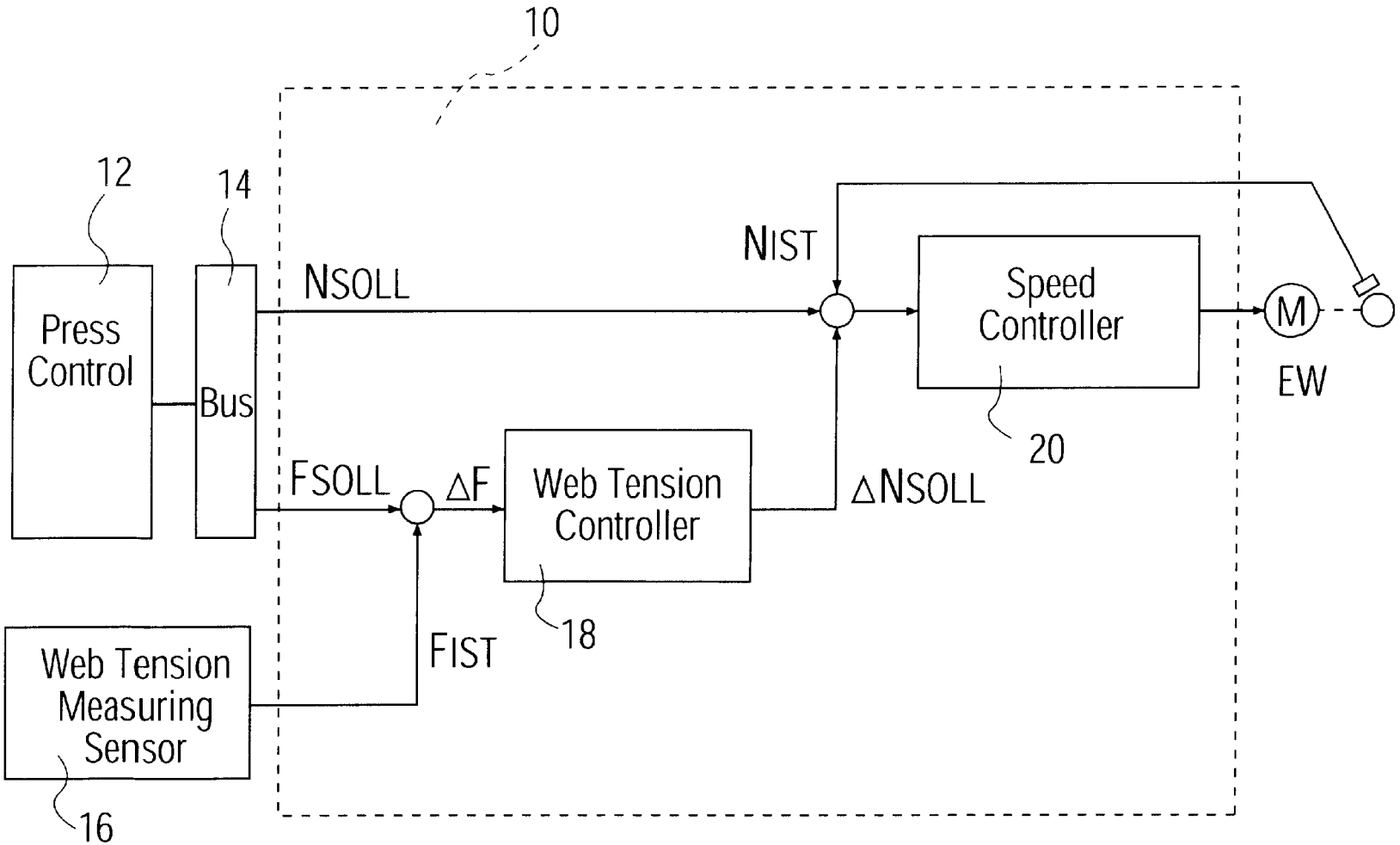
FIG. 1 is a diagram showing a web tension control device according to the present invention according to a first embodiment of the present invention.

Referring to the drawings in particular, as is apparent from FIG. 1, the speed master set point $N_{SOLL}$ and the web tension set point $F_{SOLL}$ are sent to the web tension control device 10 from a press control 12 via a real-time bus system 14. However, the web tension set point may also be fed in via analog or digital inputs without the use of a bus system. The web tension actual value $F_{IST}$ measured by a web tension measuring sensor 16 is subtracted from the web tension set point $F_{SOLL}$, from which the web tension deviation $\Delta F$ is obtained. This web tension deviation $\Delta F$ is sent to the web tension controller 18 at the draw-in mechanism, which controller 18 converts it into a lag set point $\Delta N_{SOLL}$. This lag set point $\Delta N_{SOLL}$ is linked with the speed master set point $N_{SOLL}$ obtained from the real-time bus system 14 and the measured speed actual value $N_{IST}$ and the result is sent to the speed controller 20, which drives the motor for driving a roller of the draw-in mechanism. The speed master set point $N_{SOLL}$ for the subordinate speed control circuit is thus sent to the control device 10 from a suitable real-time bus 14, e.g., SERCOS, so that an undisturbed reference signal is available as a speed master set point, so that the web tension controller and the speed controller 20 can be optimally coordinated with one another.

Figure 2:
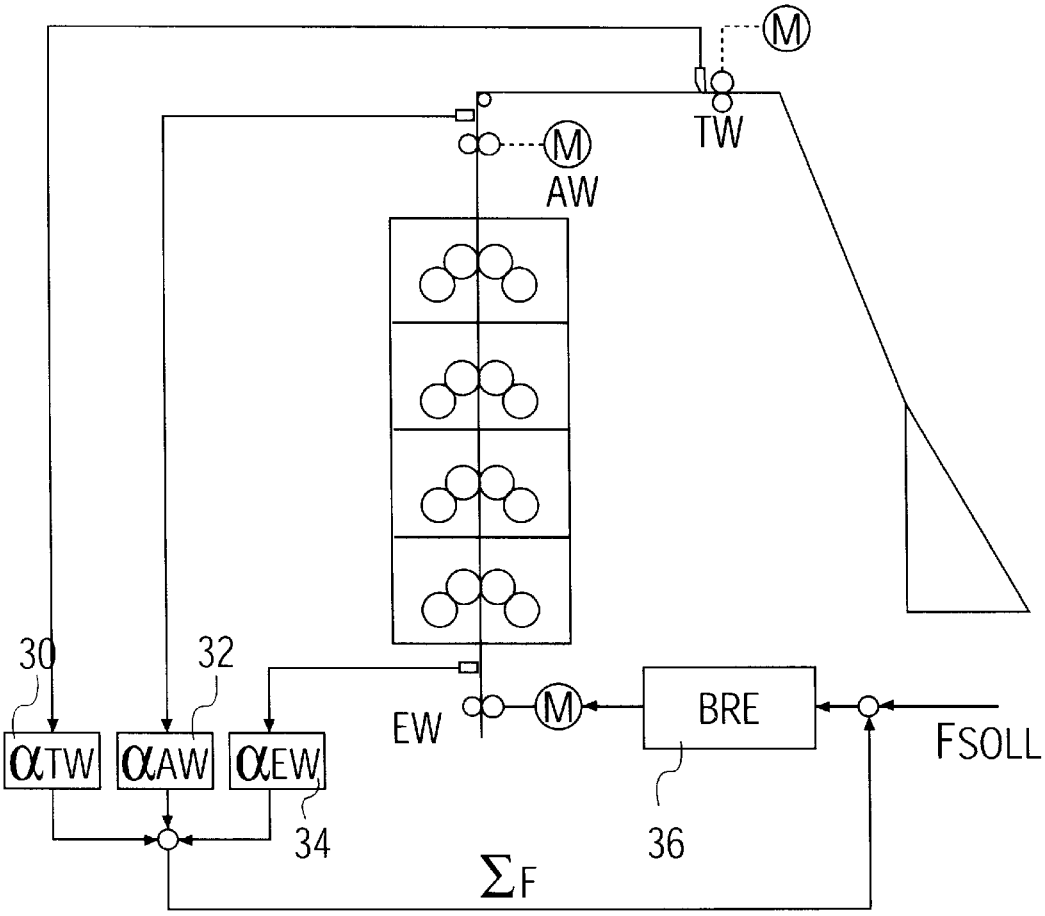
FIG. 2 is a diagram showing a web tension control device according to the present invention according to a second embodiment of the present invention.

FIG. 2 shows a second embodiment of the present invention, in which not only the measured signal of the web tension sensor EW, but also measured signals of web tension sensors at the funnel draw-in roller TW and at the draw-out mechanism AW are picked up as input parameters of the web tension control at the draw-in mechanism EW and are combined with respective coefficients $\alpha_{TW}$ at 30, $\alpha_{AW}$ at 32 and $\alpha_{EW}$ at 34. These coefficients $\alpha_i$ may be constants, but they may also represent dynamic transfer functions. A weighted sum signal $\Sigma_F$, which is used as an input value for the web tension control 36 of the draw-in mechanism EW, is formed from the output signals of these three signal-weighting units or dynamic transfer elements $\alpha_i$. Thus, web tension control may be performed at the draw-in mechanism alone, and the web tension at the draw-out mechanism AW or at the funnel draw-in roller TW can also be maintained within preset limits by the arrangement of the web tension measuring sensors shown in FIG. 2 and if the weighting factors and transfer functions $\alpha_i$ are judiciously selected, so that the web tension can be maintained in a range optimal for the color and crop marks and tearing off of the paper web can be reliably prevented from occurring despite certain interference variables caused by varying moduli of elasticity of the paper web, moisture content, velocity ramps or similar factors. The other elements of the control device were described in connection with FIG. 1 and are not shown in FIG. 2.

Figure 3:
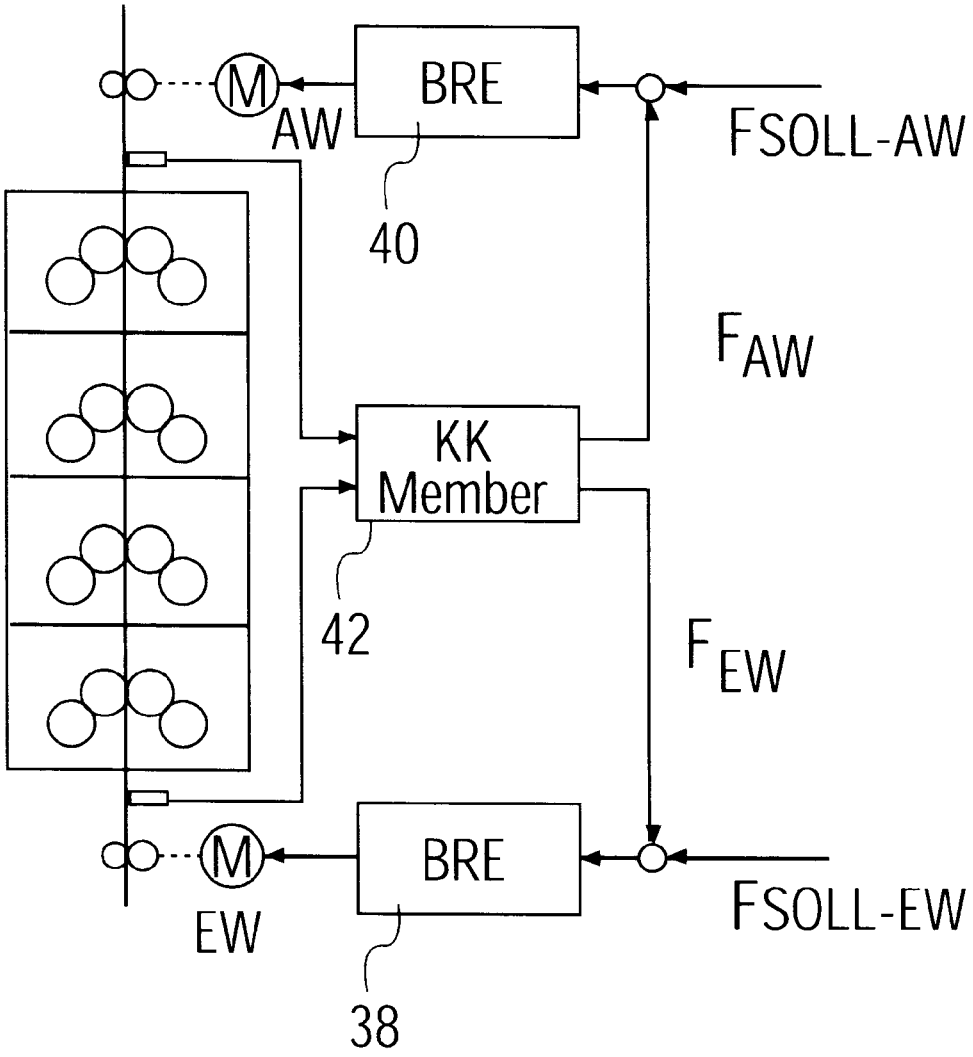
FIG. 3 is a diagram showing a web tension control device according to the present invention according to a third embodiment of the present invention.
Figure 4A:
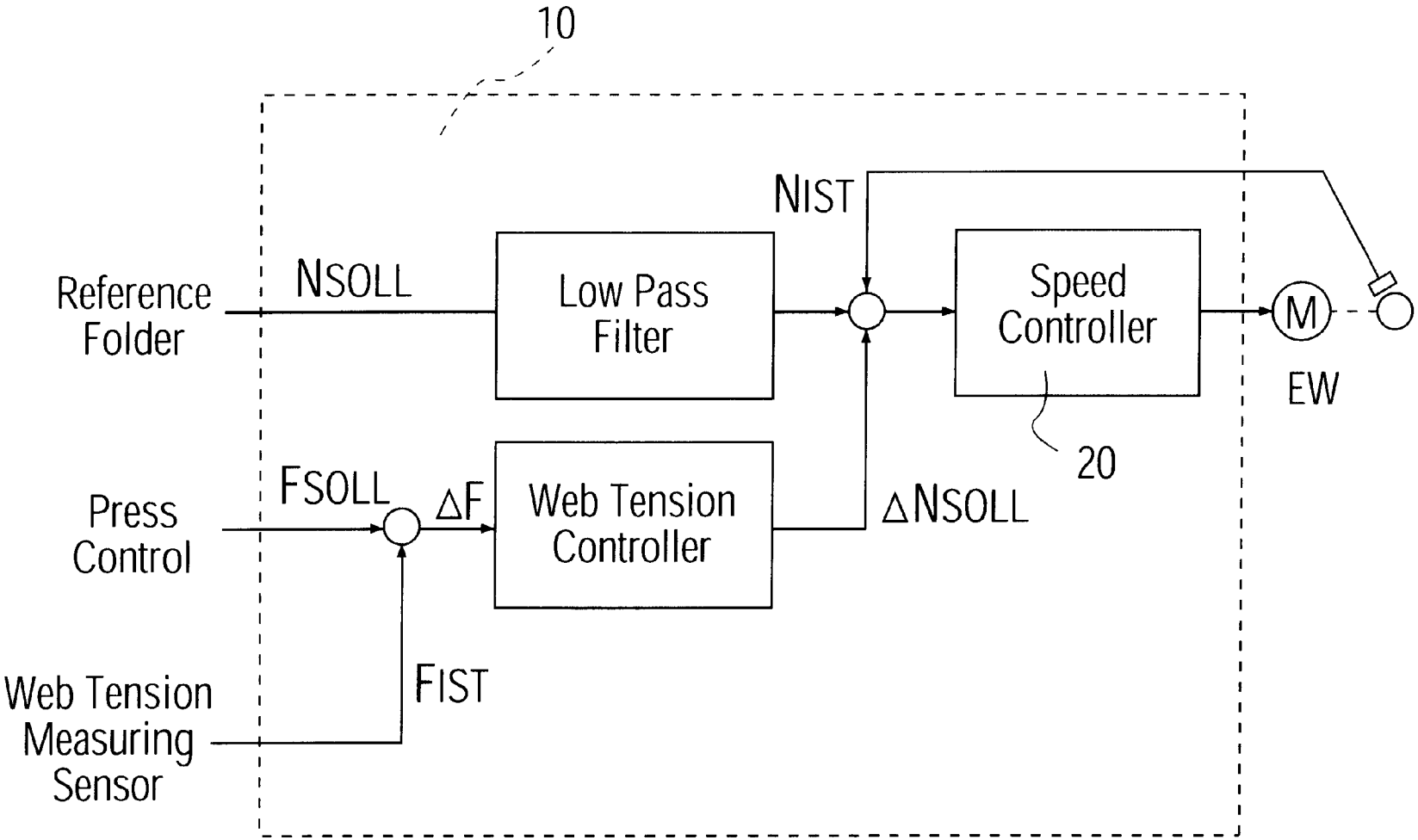
Figure 4B:
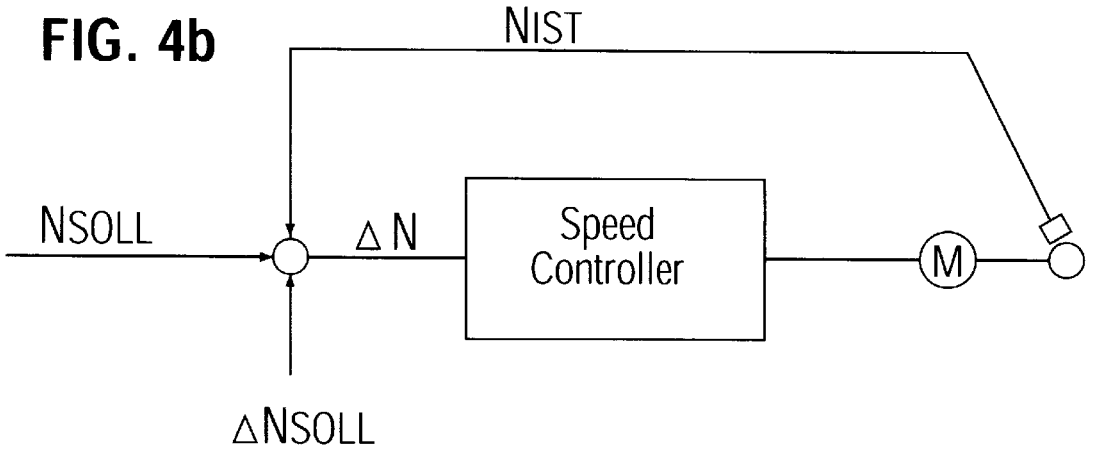
Figure 4C:
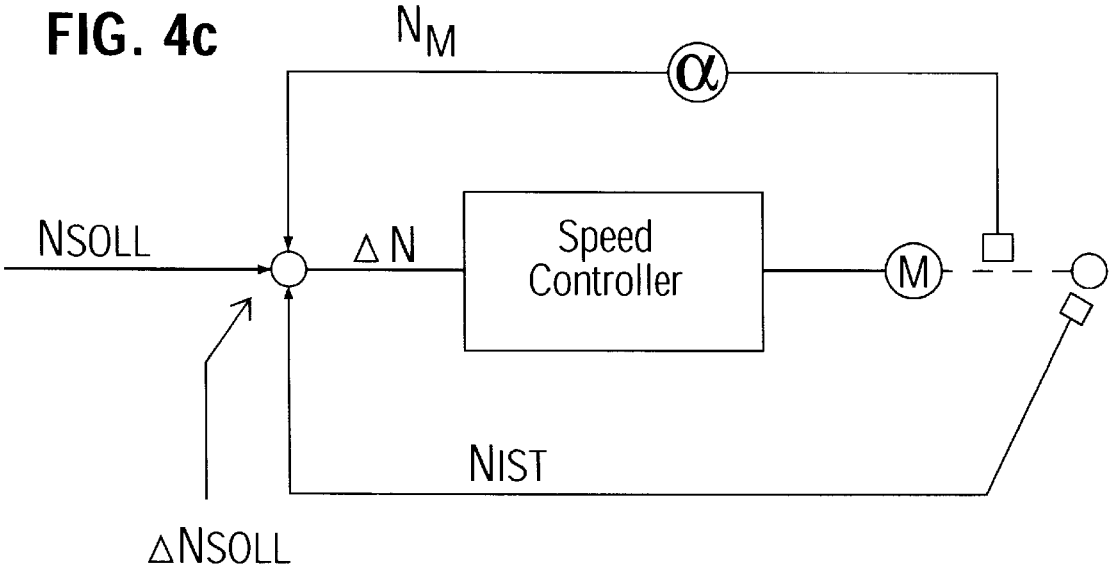
FIG. 4*c* show web tension controls according to the state of the art.
Figure 5:
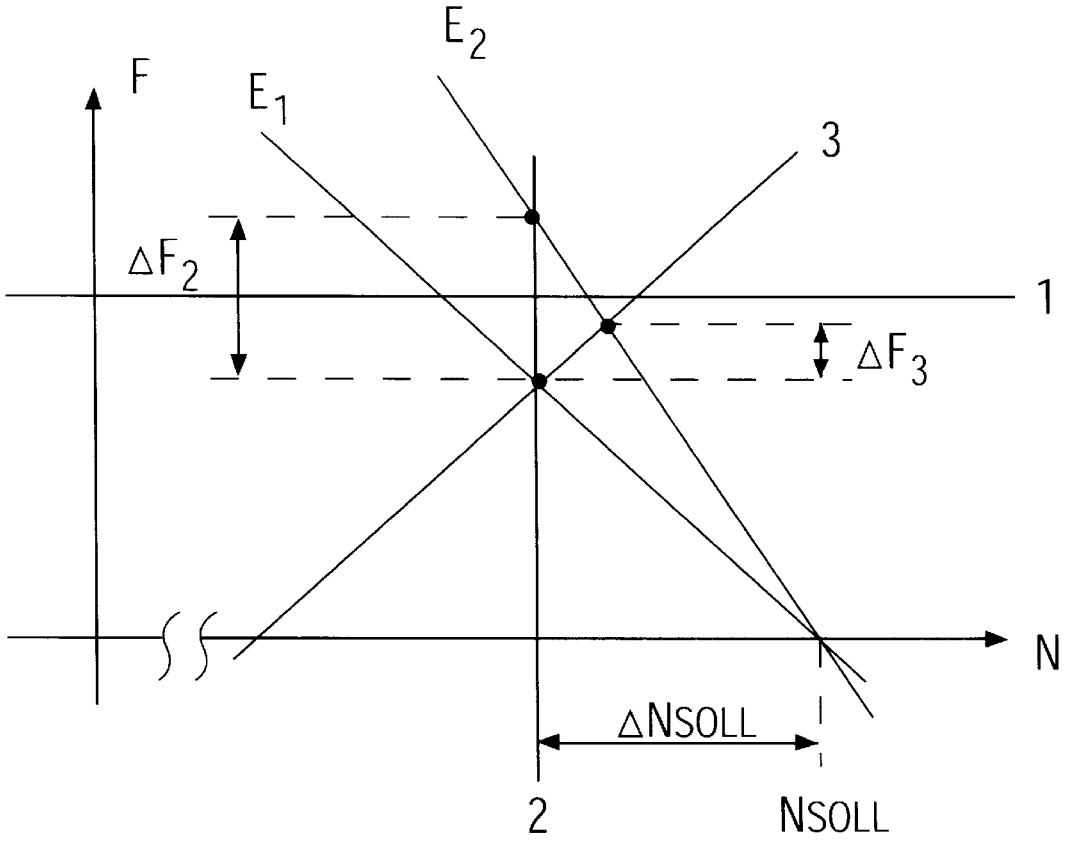
FIG. 5 shows a diagram illustrating the modes of action of the web tension controls according to FIGS. 4*a* through 4*c*.

FIG. 3 shows a third exemplary embodiment of the present invention, in which the web tension actual values of the sensors at the draw-in mechanism EW and at the draw-out mechanism AW are linked with one another and mutually taken into account in a coupling member 42, so that the respective output signals of the coupling members $F_{EW}$ and $F_{AW}$ are sent to the web tension control 31 at the draw-in mechanism EW and the control tension 40 at the draw-out mechanism EW. The coupling member 42 may perform a weighting of the measured web tension actual values of the draw-in mechanism and of the draw-out mechanism, wherein the individual signals may also be combined with dynamic transfer functions in order to thus obtain the respective output signals which represent a dynamic function of one or all input signals of the coupling member. Using such an embodiment of the present invention, it is possible to locally control the web tension, e.g., at the inlet and at the outlet of the printing tower, and the corresponding web tension actual values are also mutually taken into account in order to obtain web tension values within predetermined limits over the entire course of the paper web, so that the color and crop marks can be maintained optimally due to the web stretching maintained within certain limits.

As was determined from simulations, the web tension is independent from the speed of rotation in the case of the control according to the present invention as shown in FIG. 1, unlike in the lag control according to the state of the art, so that the web tension can be maintained within certain predetermined limits. When passing through an acceleration ramp, the force before the tower increases during the phase of acceleration of the control according to the present invention as shown in FIG. 1. This difference in force is used to accelerate the guiding rollers. After the tower, the paper web hangs between two clamping points, the last printing cylinder and the draw roller. This web force depends on the lead of the draw roller and the paper transport, which leads to the force of the web at the outlet of the printing tower, $F_{NACH}$, being dependent on the speed of rotation. However, this can be prevented with a design of the controls according to the present invention according to the exemplary embodiments shown in FIG. 2 and FIG. 3.

However, it was possible to observe that the deviation of the individual web tensions at different points of the paper path can be maintained within certain limits with the web tension control according to the present invention and the web tension is not subject to such great deviations during passage through an acceleration ramp as in the case of the lag control according to the state of the art.

It was possible to determine during a simulated comparison of the control according to the present invention with a lag control according to the state of the art during a print-off and print-on operation that the variations in the web tension in different areas can be maintained within relatively narrow limits with the control according to the present invention, whereas considerable variations of the web tension occur at individual points in the case of the use of the lag control according to the state of the art.

It was even possible to achieve improvements by coupling corresponding to the exemplary embodiment shown in FIG. 2 and especially by the cross coupling described in connection with FIG. 3.

While specific embodiments of the invention have been shown and described in detail to illustrate the application of the principles of the invention, it will be understood that the invention may be embodied otherwise without departing from such principles.

What is claimed is:

1. A control device for controlling the tension of a paper web of a printing press, the control device comprising:

a setting device for a speed master set point ($N_{SOLL}$);

a speed controller for a drive motor, which is coupled with the setting device for the speed master set point ($N_{SOLL}$);

a setting device for a web tension set point ($F_{SOLL}$);

a sensor for measuring the web tension ($F_{IST}$) at one point on the web;

a web tension controller, which is coupled with the sensor for measuring the web tension ($F_{IST}$) and with the setting device for the web tension set point ($F_{SOLL}$), said speed controller being coupled with the web tension controller and receiving an input ($\Delta N_{SOLL}$) from the web tension controller.

2. The control device in accordance with claim 1, wherein the control device is provided at the draw-in mechanism and/or at the draw-out mechanism of a printing tower.

3. The control device in accordance with claim 1, in which the setting device for the web tension set point ($F_{SOLL}$) and/or for the speed master set point ($N_{SOLL}$) is a bus system, especially a real-time bus system.

4. The control device in accordance with claim 1, wherein said sensor for measuring the web tension ($F_{IST}$) includes a sensor provided at the draw-in mechanism, a sensor at the draw-out mechanism or a sensor at the funnel draw-in roller.

5. The control device in accordance with claim 1, further comprising a transfer element with a linear or a dynamic transfer function is provided, which is combined with the output signal of the sensor.

6. The control device in accordance with claim 1, wherein two sensors are provided for measuring the web tension ($F_{IST}$) at different points of the paper web, wherein the output signals of the individual sensors are coupled with one another and are combined with transfer functions before they are sent to a local web tension control unit.

7. A process for controlling the tension of a paper web of a printing press, the process comprising the steps of:

driving one point of the web with a drive motor:

presetting a speed master set point;

presetting a web tension set point;

measuring a first web tension actual value;

forming a difference between the web tension set point and the measured web tension actual value;

converting the formed difference between the web tension set point and the measured web tension actual value into a lag or lead set point;

forming a variable from the preset speed master set point and the lag or lead set point; and using the formed variable to control the speed of rotation of the drive motor.

8. The process in accordance with claim 7, wherein the web tension is measured at the draw-in mechanism and/or at the draw-out mechanism and/or at the funnel draw-in roller.

9. The process in accordance with claim 7, wherein the web tension value or values measured is/are combined with a transfer function.

10. The process in accordance with claim 7, wherein at least two measured web tension values are cross-coupled in order to deliver a web tension actual value signal for the web tension control.

11. The process in accordance with claim 7, wherein the web tension is controlled at the draw-in mechanism and/or at the draw-out mechanism.

12. The process in accordance with claim 7, wherein:

said speed master set point and said web tension set point are simultaneously preset in a freely selectable manner.

13. The control device in accordance with claim 1, further comprising a press control providing both said speed master set point and said web tension set point.

14. A control device for controlling tension of a web of a printing press, the control device comprising:

a drive motor for driving one point of the web;

a speed setting device for selectively setting a speed master set point ($N_{SOLL}$);

a speed controller for said drive motor and coupled with said setting device for said speed master set point ($N_{SOLL}$);

a tension setting device for selectively setting a web tension set point ($F_{SOLL}$);

a first tension sensor for measuring a first actual web tension ($F_{IST1}$) at a first web point;

a second tension sensor for measuring a second actual web tension ($F_{IST2}$) at a second web point;

a coupling member for receiving said first and second actual web tensions, said coupling member combining said first and second actual web tensions to form a tension signal;

a web tension controller combing said web tension set point with said tension signal to generate a lag set point ($\Delta N_{SOLL}$), said speed controller combining said lag set point ($\Delta N_{SOLL}$) with said speed master set point ($N_{SOLL}$) to control said drive motor.

15. The device in accordance with claim 14, further comprising;

a speed sensor for measuring an actual speed of the web at said first point, said speed controller combining said actual speed with said lag set point ($\Delta N_{SOLL}$) and said speed master set point ($N_{SOLL}$) to control said drive motor.

16. The device in accordance with claim 14, wherein:

another drive motor drives another point of the web;

said coupling member combines first and second actual web tensions to form another tension signal;

another web tension controller combes said web tension set point with said another tension signal to generate another lag set point;

another speed controller controls said another drive motor, said another speed controller combines said another lag set point with said speed master set point ($N_{SOLL}$) to control said another drive motor.

17. The process in accordance with claim 7, wherein:

a second web tension actual value is measured at a point spaced from said measuring of said first web tension actual value;

said forming of said difference includes combining said first and second web tension actual values.

18. The process in accordance with claim 7, further comprising:

measuring an actual speed of the web at said one point;

combining said actual speed with said lag set point ($\Delta N_{SOLL}$) and said speed master set point ($N_{SOLL}$) to control said drive motor.

19. The process in accordance with claim 17, further comprising:

driving another point of the web with another drive motor;

forming another difference between the web tension set point and the web tension actual values;

converting said another difference into another lag set point;

forming a another variable from the preset speed master set point and said another lag set point;

using the another variable to control a speed of rotation of said another drive motor.

* * * * *